United States Patent [19]

Hammar

[11] 4,296,767

[45] Oct. 27, 1981

[54] METHOD AND APPARATUS FOR CLEANING A CONTINUOUS WEB OF MATERIAL

[75] Inventor: Jan E. Hammar, Enebyberg, Sweden

[73] Assignee: Forenade Fabriksverken, Eskilstuna, Sweden

[21] Appl. No.: 129,673

[22] Filed: Mar. 12, 1980

[30] Foreign Application Priority Data

Mar. 16, 1979 [SE] Sweden ..... 7902382

[51] Int. Cl.[3] ..... B08B 5/04

[52] U.S. Cl. ..... 134/15; 15/306 A; 83/100; 83/168; 134/21

[58] Field of Search ..... 134/9, 15, 21; 15/306 A, 308, 309; 83/100, 168, 169; 55/290, 354, 414, 418

[56] References Cited

U.S. PATENT DOCUMENTS 2,818,595 1/1958 Rosewall ..... 15/306 A
2,980,933 4/1961 Schwartz et al. ..... 15/306 A X
3,272,651 9/1966 Quirk ..... 15/306 A X
3,775,806 12/1973 Olbrant et al. ..... 15/306 A

*Primary Examiner*—Marc L. Caroff
*Attorney, Agent, or Firm*—McCormick, Paulding & Huber

[57] ABSTRACT

A method and an apparatus for cleaning a continuous web of material (1), for instance a paper web, whereby the web of material is brought to pass through a suction chamber (2) having inlet (12) and outlet (13) for the web of material and one or more air outlets (11), for instance at the bottom thereof, which outlets are connected to a suction source. A means (4) for working the web of material (1) may be provided inside the suction chamber. The inlet (12) and the outlet (13) have substantially the same cross-section area. The amount of air entering the suction chamber through the web inlet (12) is restricted to cause a greater amount of air to flow into the suction chamber through the web outlet (13) than flows into the suction chamber through the web inlet (12).

16 Claims, 4 Drawing Figures

METHOD AND APPARATUS FOR CLEANING A CONTINUOUS WEB OF MATERIAL

The present invention relates to an apparatus for cleaning a continuous web of material from dust and other loose particles.

When handling continuous webs of material and especially when working the web there is often formed dust and other loose particles which deposit on the web and possibly also are sucked onto the web depending on static electricity. Dust and other particles which have deposited on the web may make the subsequent working of the web difficult and may impare the result of the subsequent working. It is therefore essential that the web is cleaned from dust and other particles for it is subjected to subsequent working.

The invention has been brought to mind especially in connection to handling of webs of paper, for instance in connection to printing the web of paper. The problem may be especially troublesome perforating a web of material by means of a perforating apparatus of the type in which the web is stretched over tool rings or tool rollers formed with raised pins corresponding to the intended perforation holes, and in which one or more milling tools mill off the paper at the said pins from the opposite side of the paper web. Thereby large amounts of dust and fibres are formed which deposit on the paper web and stick thereto. The floating dust and fibres also may be considered a health risk for the persons operating the apparatus.

The main object of the invention therefore is the problem to provide a method and an apparatus for cleaning a continuous web of material from dust and other light particles which both deposit on and stick to the web and also float freely within an area around the web of material or around a possible working apparatus for the web of material.

The attempts have been made to solve the problem by mounting the apparatus for working the web of material inside a box having inlet and outlet for the web and an outlet for the connection of a vacuum apparatus intended to suck dust and other particles away from the web of material and from the surrounding box. Some results have been obtained, but still a web handled as mentioned carries a too large amount of dust and particles. The reason therefore is believed to bee that a large amount of the air which is sucked out of the box is received from the inlet of the box in which the web of material has a relatively low amount of dust and particles as compared with the portion of the web at the outlet of the box which carries a large amount of dust and particles.

Therefore it is a wish to reduce the amount of air which is sucked into the box at the inlet to a minimum and to increase the amount of air which is sucked into the box at the outlet to a corresponding degree. For practical reasons the inlet opening can not be made substantially smaller than the outlet opening, since the web of material must have some clearance in order not to be dammaged by the edges of the inlet and the outlet respectively. Consequently the inlet and the outlet must have substantially the same cross-section area, and the invention is especially concerned with the problem to reduce the amount of air entering at the inlet while maintaining substantially the same cross-section area as the area of the outlet.

Further characteristics of the invention will be evident from the following detailed specification in which reference will be made to the accompanying drawings.

In the drawings

FIG. 1 diagrammatically shows a cross-section through an apparatus according to the invention.

Figure 1:
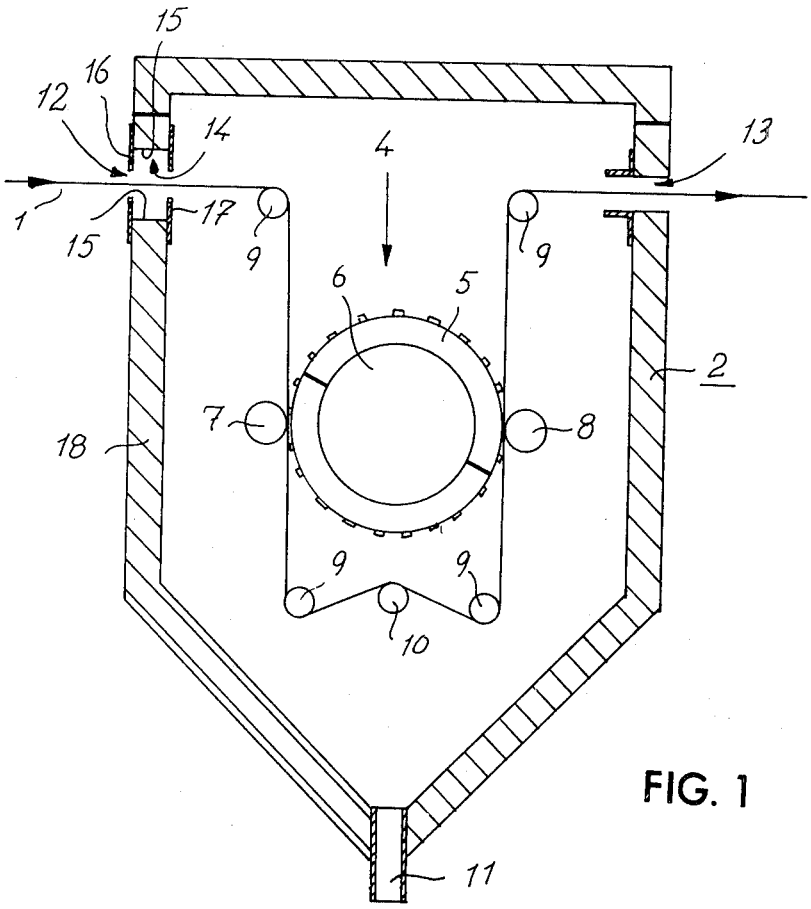

As mentioned above FIG. 1 illustrates an apparatus for handling and working of a web 1 of paper or any other material which passes through a suction chamber while being cleaned from dust and other particles. The suction chamber 2 may comprise an apparatus for working the web of material, for instance a perforating apparatus comprising one or more tool rings 5 mounted on a shaft 6 and co-operating with two milling tools 7, 8 milling the paper away at the places of the perforator ring projecting outside the periphery of the said perforator ring. For guiding and directing the web of material 1 there are several pulleys 9 and a register roller 10 by means of which the web of material can be formed with different long slings for adjusting the distance between the perforation holes provided by the mill roller 7 and the mill roller 8 respectively.

At the bottom of the suction chamber 2 an air outlet is provided. The air outlet 11 is connected at a non-illustrated suction apparatus which sucks air into the vacuum chamber through an inlet 12 and an outlet 13 of the vacuum chamber for the web and which sucks air together with mill dust, fibres and other particles out of the suction chamber which particles have been formed by the perforating apparatus 4 inside the suction chamber and which may also be present on the web before entering the suction chamber.

Of course the apparatus may comprise several air suction outlets 11 and such air outlets may be provided either at the bottom as illustrated in FIG. 1 or at the top, besides or at several different places of the suction chamber.

At the inlet 12 the web carries a rather small amount of dust and other particles, whereas the outlet 13 it carries a substantially larger amount of dust and other particles. It is therefore a wish to allow as small amount of air as possible to enter through the inlet 12 and oppositly to allow the largest possible amount of air to enter the suction chamber through the outlet 13. In order to give the web a possibility of moving slightly without being damaged it has proved that both the inlet 12 and the outlet 13 must have a slot width exceeding a predetermined smallest width. If the width of the slot at the outlet 13 is formed larger than the said smallest width there is a too large air inlet in the suction chamber 2 and thereby an impaired suction of dust and particles out of the chamber. A large width of the slot at the outlet 13 also reduces the possibility for the air to remove dust and particles from the surface of the paper web at the outlet. In order to be able to reduce the amount of incoming air in the inlet it is therefore necessary to try other solutions than to vary the width of the air slots at the inlet 12 and 13 respectively.

Quite accidentally it was observed that a substantially reduction of the amount of incoming air at the inlet was obtained if the inlet was designed so as to form a hollow chamber 14 the top and bottom 15 of which are provided by portions of the suction chamber 2 and the sides of which are provided by thin bars 16 and 17 mounted on both sides of the wall 18 of the suction chamber and having a predetermined overhang in relation to the bottom and the top 15 of the hollow chamber 14.

Figure 2:
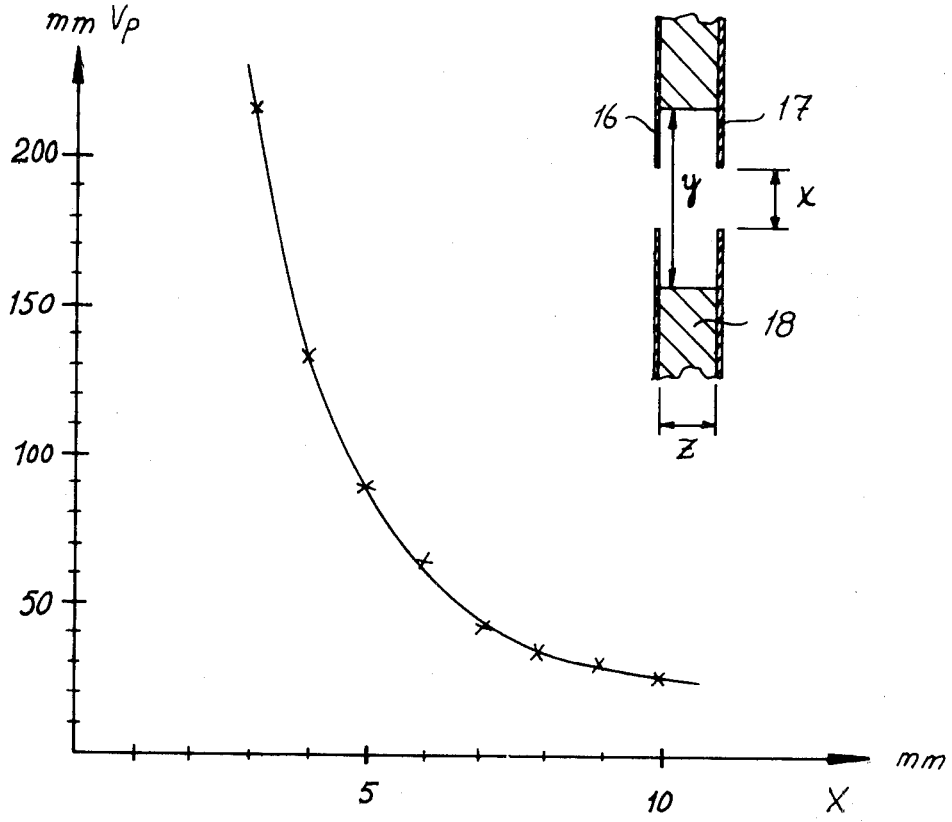
FIG. 2 is a diagram illustrating the relationship between the width of the air inlet slot and the sub-treasure provided by a specific vacuum suction means in a working chamber for a paper web for unchanged width of the outlet slot of the working chamber.

In order to investigate the influence of the slot width at the inlet 12 of the described apparatus a number of experiments were made for which account is given in FIG. 2. During the experiments the width of the outlet 13 was kept unchanged and the overhang of the bars 16 and 17 was maintained constant and of 9 mm round the entire inlet. Along the horizontal shaft the width X is stated in millimeters and along the vertical shaft the sub-pressure formed in the suction chamber is stated measured in water column Vp.

It is evident from the curve that the sub-pressure of the suction chamber drops exponentially upon increasing width of the slot. As evident the sub-pressure at 3 mm width of the slot is 218 mm water column Vp, and the sub-pressure thereafter drops upon increasing width of the slot so that the sub-pressure for 10 mm width of the slot is only 26 mm water column Vp. The curve flattens out asymptotically in both directions. Considering the appearance of the curve it ought to be a wish to make the width of the slot as small as 3 mm or less, whereby a strong sub-pressure is obtained what indicates that a very small amount of air is sucked into the chamber through the inlet 12. For practical reasons it is not possible as mentioned above to design the width of the slot to small and in this specific case it was established that a slot width of 5 mm was a practical and suitable value. Consequently the width of the slot at the inlet 12 in this case should not, if possible, exceed a width of 5 mm.

Figure 3:
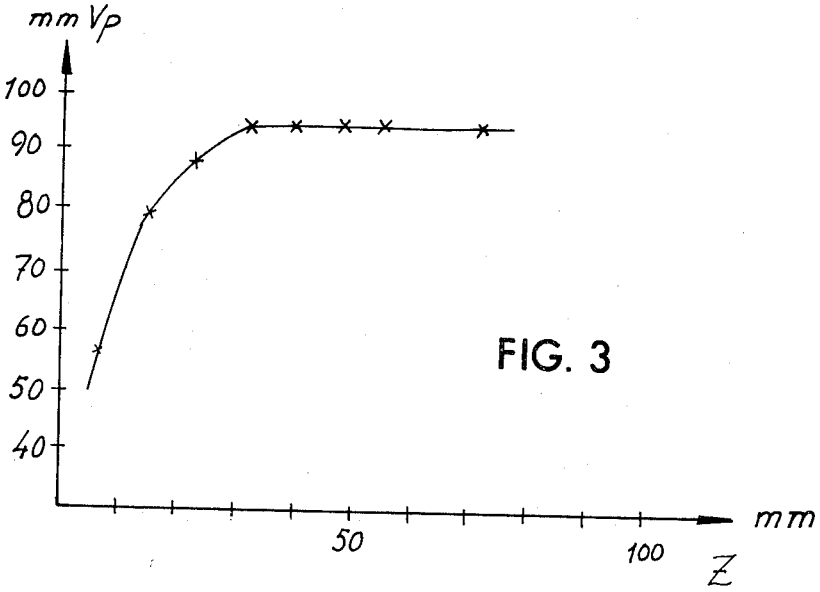
FIG. 3 is a diagram illustrating the influence of the thickness of the wall on the sub-pressure provided in the suction chamber.

It might be close at hand to believe that the thickness of the wall 18, corresponding to the distance between the slot bars 16 and 17, should be as large as possible in order to give as small amount of entering air as possible. In order to investigate this question another series of experiments were made for which account is given in FIG. 3. In the figure the thickness Z of the wall 18 is given in mm along the horizontal shaft and the sub-pressure in mm water column Vp is marked along the vertical shaft. Also in this series of experiments the slot width of the outlet 13 was kept unchanged and also the capacity of the suction apparatus was kept unchanged. It is evident from the curve that the sub-pressure of the suction chamber 2 rises strongly at a first phase for increasing thickness of the wall. Surprisingly, however, it could be stated that the curve flattens out nearly to a horizontal curve when the wall thickness was increased over 32 mm. Therefore it could be stated that an optimum was obtained for a wall thickness of 32 mm, i.e. a distance of 32 mm between the two inlet bars 16 and 17.

Other experiments have previously shown that a substantially stronger reduction of the amount of air entering through the inlet is obtained if the inlet bars 16 and 17 are given a predetermined overhang over the bottom and top edges 15 at the inlet. The reason therefore is not quite made clear but it may be supposed that turbulent air flows are formed in the hollow chamber 14 which reduce ability of air to flow through the inlet.

Figure 4:
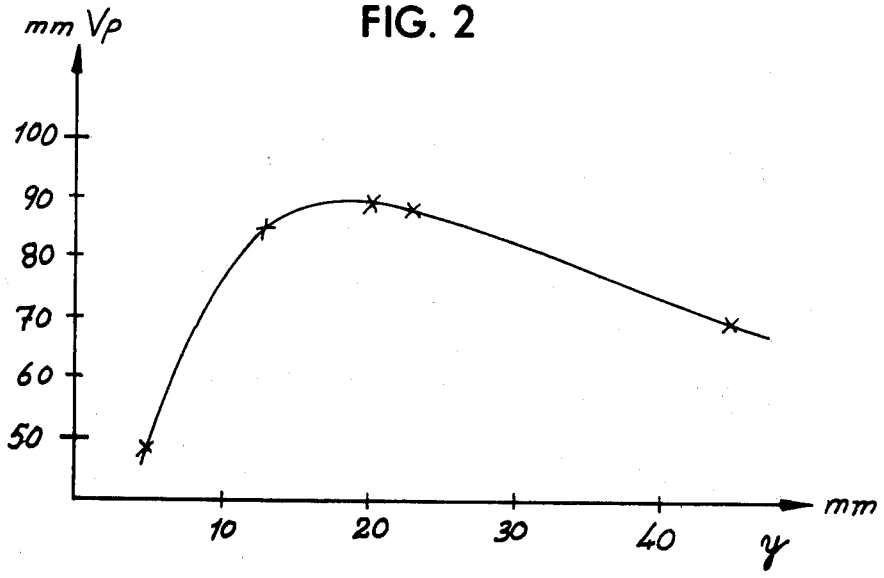
FIG. 4 is a diagram illustrating the influence of overhang in a specific embodiment of the air inlet of the suction chamber.

In order to investigate the influence of the said overhang a further series of experiments were made for which account is given in FIG. 4. During the experiments the slot width over the inlet bars 16 and 17 was kept constant of 5 mm, and also the slot width at the inlet 13 was kept constant. Also the capacity of the suction apparatus connected at the air outlet 11 was maintained. Along the horizontal shaft is stated the distance y between the bottom and the top 15 on both sides of the inlet, and along the vertical shaft is given the sub-pressure of the suction chamber also in this case measured in mm water column Vp. It is evident that the sub-pressure rises strongly upon increasing the distance Y as far as to a value of the width y of 15–20 mm, whereupon the curve begins to drop. An optimum value of y is obtained between 15 and 25 mm, and consequently it could be stated that the overhang on both sides of the inlet opening for obtaining the best possible result should be about 5 à 10 mm in relation to the bottom and the top 15 of the opening.

Further experiments have proved that it is possible to further reduce the amount of air entering the inlet 12 by providing several hollow chambers 14 of the above described type following each other. The effect thereof, however, is relatively limited. Other experiments with other forms and types of the outlet opening have shown that an outlet having straight and smooth walls gives the best result.

It is to be understood that the invention is not restricted to the embodiments described above and shown in the drawings, but all kinds of different modifications may be presented within the scope of the following claims.

I claim:

1. A method for cleaning a web of material (1) to remove dust and other loose particles from the material and comprising the steps of moving the web of material (1) through a suction chamber (2) including a web inlet (12) and a web outlet (13) of substantially equal cross sectional area and at least one air outlet (11) connected to a source of sub-pressure, and restricting the amount of air entering the suction chamber (2) through the inlet (12) by providing spaced apart limit walls (16, 17) at said inlet to define a hollow chamber (14) at said inlet (12).

2. A method according to claim 1, characterized by forming both the inlet (12) and the outlet (13) with a maximum width of 5 mm, and forming the limit walls (16, 17) at the inlet (12) with an overhang of 5–10 mm beyond the bottom and top of the hollow chamber (14).

3. A method according to either claim 1 or claim 2, characterized by maintaining a distance of at least 32 mm between the limit walls (16, 17) in the longitudinal direction of the web of material (1).

4. A method for cleaning a web of material (1) to remove dust and other loose particles from the material (1) and comprising the steps of moving the web of material (1) through a suction chamber (2) having a web inlet (12) and a web outlet (13) having substantially the same cross sectional area, and at least one air outlet (11), connecting the one air outlet (11) to a source of sub-pressure, and restricting the amount of air entering the suction chamber (2) through the web inlet (12) to cause a greater amount of air to flow into the suction chamber (2) through the web outlet (13) than flows into the suction chamber (2) through the web inlet (12).

5. A method for cleaning a web of material (1) according to claim 4 further characterized by the step of forming the web inlet (12) and the web outlet (13) with the same cross sectional area and wherein the step of restricting the amount of air entering the suction chamber (2) through the web inlet (12) is further characterized as creating air turbulence within said web inlet (12).

6. A method for cleaning a web of material (1) according to either claim 4 or claim 5 wherein the step of restricting the amount of air entering the suction chamber (2) through said web inlet (12) is further characterized as forming a hollow chamber (14) at the web inlet (12) through which air entering said suction chamber (2) through said web inlet (12) is constrained to pass.

7. A method for cleaning a web of material (1) according to claim 6 wherein the inlet comprises an opening (15) in the suction chamber (2) and the step of forming a hollow chamber (14) is further characterized as providing limit walls (16, 17) at opposite sides of the suction chamber wall (18) overhanging associated edges of the opening (15).

8. Apparatus for cleaning a continuous web of material (1) to remove dust and other particles from the material (1) and comprising a closed suction chamber having a web inlet (12) and a web outlet (13) and at least one air outlet (11) connected to a source of sub-pressure, said web inlet (12) being defined by an opening (15) in the suction chamber wall (18), said inlet (12) and said web outlet (13) having substantially the same cross sectional area, said inlet (12) being further defined by limit walls (16, 17) at opposite sides of said opening (15), said limit walls (16, 17) overhanging associated edges of said opening (15) and cooperating with said suction chamber wall (18) to define a hollow chamber (14) at said inlet (12) through which the material (1) is constrained to pass in entering the suction chamber (2).

9. Apparatus according to claim 8, characterized in that the limit walls (16, 17) of the inlet (12) have an overhang over the opening (15) of the suction chamber wall (18) of 5–10 mm.

10. Apparatus according to either claim 8 or claim 9, characterized in that a means (4) for working the web of material (1) is mounted inside the suction chamber (2).

11. Apparatus according to claim 10, characterized in that the web of material is a paper web (1), and in that the working means (4) inside the suction chamber (2) is a perforating apparatus which by a milling method mills different portions out of the web of material (1).

12. Apparatus according to either claim 8 or claim 9, characterized in that the suction chamber at the bottom is conically converging in the direction dropwise, and in that the air outlet (11) is provided at the tip of the cone.

13. Apparatus for cleaning a web of material (1) to remove dust and other particles from the web of material (1), said apparatus comprising a means defining a suction chamber (2) having a web inlet (12) and a web outlet (13) having substantially the same cross sectional area, said suction chamber having at least one air outlet (11), means connected to said one air outlet (11) for reducing air pressure within said suction chamber (2), and means associated with said web inlet (12) for restricting the flow of air into said suction chamber (2) through said web inlet (12) to permit a greater amount of air to enter said suction chamber (2) through said web outlet (13) than enters said suction chamber through said web inlet (12).

14. Apparatus according to claim 13 wherein said means for restricting the flow of air into said suction chamber (2) through said web inlet (12) comprises means for creating air turbulence within said web inlet (12).

15. Apparatus according to either claim 13 or claim 14 wherein said means for restricting the flow of air into said suction chamber through said web inlet (12) comprises means defining a hollow chamber (14) comprising said web inlet (12) and through which air entering said suction chamber (2) through said web inlet (12) is constrained to pass.

16. Apparatus as set forth in claim 15 wherein said hollow chamber (14) is defined by an opening (15) in the suction chamber wall (18) and limit walls (16, 17) at opposite sides of said suction chamber wall (18) and overhanging associated edges of said opening (15).

* * * * *